US005259462A

United States Patent [19]

Kimberlin

[11] Patent Number: 5,259,462

[45] Date of Patent: Nov. 9, 1993

[54] SOFT MOUNT AIR DISTRIBUTOR

[75] Inventor: Robert R. Kimberlin, Troutville, Va.

[73] Assignee: Ingersoll-Rand Company, Woodcliff Lake, N.J.

[21] Appl. No.: 936,489

[22] Filed: Aug. 28, 1992

[51] Int. Cl.[5] ..... B25D 17/24

[52] U.S. Cl. ..... 173/17; 173/135; 173/211

[58] Field of Search ..... 173/17, 162.1, 206, 173/211, 138, 135, 212

[56] References Cited

U.S. PATENT DOCUMENTS 3,511,137 5/1970 Smith ..... 173/162.1
3,599,730 8/1971 Tyreso et al. ..... 173/17
3,848,680 11/1974 Legler .
3,920,086 11/1975 Goppen et al. .
3,972,119 8/1976 Bailey .
4,007,798 2/1977 Gazda .
4,068,727 1/1978 Andersson et al. ..... 173/212
4,074,777 2/1978 Anderson et al. .
4,558,763 12/1985 Montabert .
4,571,976 2/1986 Schwab .
4,592,431 6/1986 Tornquist ..... 173/162.1
4,723,610 2/1988 Dummermuth et al. ..... 173/162.1
4,880,065 11/1989 McDonald et al. .
4,999,002 3/1991 Fink .
5,018,792 5/1991 Roussin et al. .
5,109,932 5/1992 Bueter et al. ..... 173/17

*Primary Examiner*—Scott Smith
*Attorney, Agent, or Firm*—John J. Selko

[57] ABSTRACT

A valveless percussive pneumatic drill includes a housing, a piston in the housing, reciprocating along the axis of the housing, a piston support bearing in the housing and an air distributor in the housing, the air distributor being mounted in the housing for flexible elastic movement therein, to permit slight misalignment of the piston with respect to the axis of the housing.

4 Claims, 2 Drawing Sheets

SOFT MOUNT AIR DISTRIBUTOR

BACKGROUND OF THE INVENTION

This invention relates generally to pneumatic percussive drills, and more particularly to air distributors in valveless, percussive air drills.

Valveless percussive air drills consist basically of a main housing, a reciprocal piston in the housing, a bearing supporting the piston and an air distributor that distributes air via various passageways to activate the piston between a drive stroke and a return stroke. As the drill operates, the piston reciprocates due to the cycling of air pressure differentials across the head of the piston. The alignment of the piston in such a device consists of three bearing points of contact for the piston: contact with the air distributor, contact with the housing and contact with the bearing. This three point contact demands extremely high manufacturing tolerances in order to assure proper function characteristics of the cycle.

Misalignment of any one these components may cause premature failure of the drill because of the loss of alignment of three contact points spaced along the length of the longitudinal axis of reciprocation of the piston. This condition is made more difficult because the piston has an elongated tail stem that can exaggerate any misalignment problems during the cycle.

The foregoing illustrates limitations known to exist in present devices and methods. Thus, it is apparent that it would be advantageous to provide an alternative directed to overcoming one or more of the limitations set forth above. Accordingly, a suitable alternative provided including features more fully disclosed hereinafter.

SUMMARY OF THE INVENTION

In one aspect of the present invention, this is accomplished by providing a pneumatic drill having an elongated housing forming an internal cavity with a longitudinal axis, a piston in the housing reciprocal along the longitudinal axis, a piston support bearing in the housing, the piston being aligned along the longitudinal axis by the housing and support bearing; and a fluid distributor in the housing flexibly mounted therein for movement along the longitudinal axis and transverse to the longitudinal axis.

The foregoing and other aspects will become apparent from the following detailed description of the invention when considered in conjunction with the accompanying drawing figures.

BRIEF DESCRIPTION OF THE DRAWING FIGURES

FIG. 1 is cross-sectional view, with parts removed, of the invention, with the piston in the drive stroke position; and FIG. 2 is a view similar to FIG. 1, with the piston in the return stroke position.

DETAILED DESCRIPTION

Figure 1:
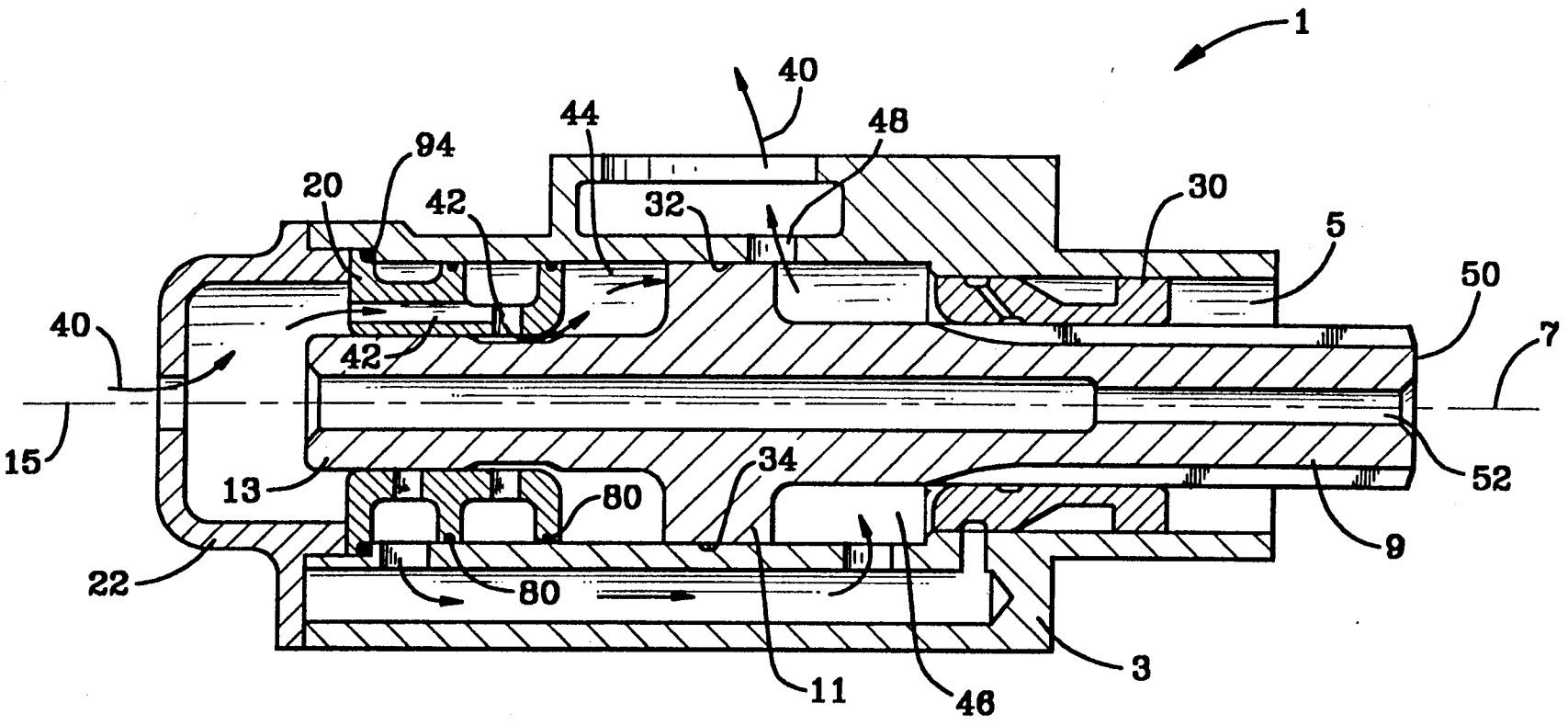

Referring to the drawings, a pneumatic drill 1 is shown having an elongated housing 3 forming an internal cavity 5, with a longitudinal axis 7 extending therethrough. Drill 1 is operated by percussive flow of a fluid, preferably air, and is known in the art as a valveless drill. Such a drill does not require a valve to cause reversal of fluid flow, but uses a combination of passageways and ports, as described hereinafter.

Piston 9 has a head 11, a tail stem 13 and a longitudinal axis 15. Ideally, axis 15 coincides with axis 7 as piston 9 reciprocates in housing 3 along longitudinal axis 7. Air distributor 20 is positioned in housing 3 between a backhead 22 and head 11 of piston 9. Piston 9 is aligned for reciprocation along axis 7 by sliding contact with piston bearing 30 and housing 3 at contact surfaces 32 and land portion 34 of head 11, as is well known.

In operation, at the beginning of the drive stroke (which is the end of the return stroke), fluid is flowing, as shown by arrows 40 of FIG. 1. Fluid is flowing through backhead 22, distributor 20, via passageways 42, into drive chamber 44. At this piston position, fluid is being exhausted from return chamber 46 via port 48. Fluid is also being exhausted out around front end 50 of piston 9 and through passageway 52 in piston 9, as is well known.

Figure 2:
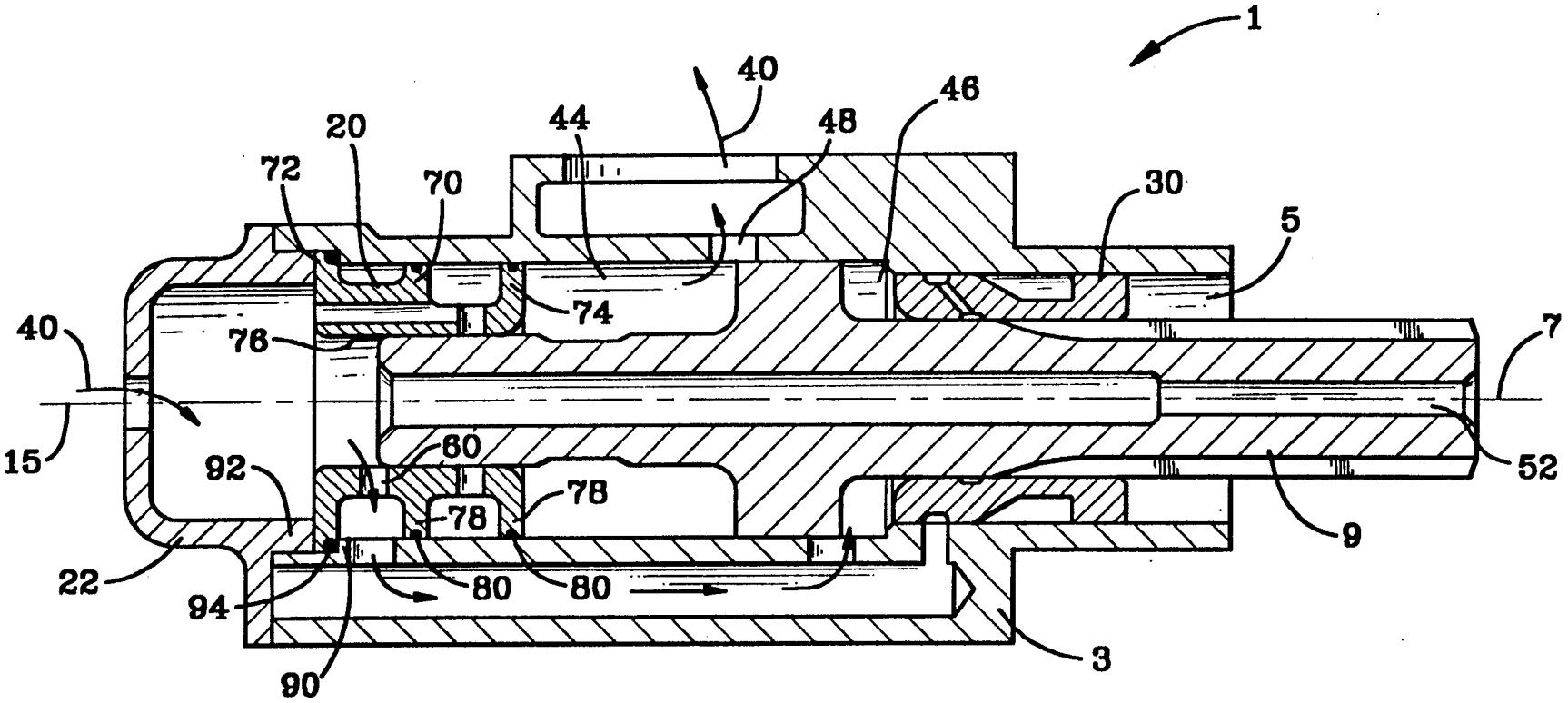

Pressure in drive chamber 44 forces piston 9 forward to the end of the drive stroke (which is the beginning of the return stroke), as shown in FIG. 2. At this piston position, fluid is being exhausted from drive chamber 44 via port 48. It is also being exhausted out passageway 52. Fluid is flowing through backhead 22, air distributor 20, via passageways 60 into return chamber 46. Pressure in return chamber 46 forces piston 9 back to the end of the return stroke (which is the beginning of the drive stroke).

The details of the passageways and porting are well known, and any workable arrangement that is valveless will do.

The air distributor 20 includes a body portion 70, having a flanged top end 72 and a flanged bottom end 74. Body portion 70 has an inner surface 76 forming a central passageway around distributor axis 15. Inner surface 76 slidingly contacts stem 13 to align piston 9 along housing axes 7, 15. Fluid passageways 42, 60 are provided in body 70, as described hereinabove.

The outer surface of body 70 has a plurality of raised land surfaces 78 extending around the perimeter of body 70, encircling distributor axis 15. Each land surface 78 has a groove therein extending in a direction that likewise encircles distributor axis 15. Each groove has removably positioned therein an elastic seal member 80, such as a rubber O-ring. Seal member 80 extends above land surface 78 to frictionally contact housing 3 to stop any fluid flow in the area of the contact. Elastic seal member 80 permits slight movement of distributor 20 back and forth in housing 3 in a direction that is not parallel to axis 15 (referred to herein as a "transverse direction") as well as slidingly along a direction that is parallel to distributor axis 15.

Air distributor 20 is fixed in housing 3 by flanged end 72 being held between a first shoulder 90 in housing 3 and a second shoulder 92 in backhead 22. The mounting in housing is flexible by reason of the fact that a second elastic seal member 94, such as a rubber O-ring, is sealingly positioned between end 72 and shoulder 92. Seal member 94 provides flexible movement of air distributor along axis 7, as well as transverse to axis 7. I prefer the O-rings to be a nitrile rubber material.

This flexible mounting of distributor 20 I call "soft mounting" and it permits distributor 20 to follow a stem 11 that is misaligned and vibrates slightly.

I have discovered that soft mounting of the distributor 20 is unexpectedly enhanced, if the distributor 20 is elastically deformable under conditions of high load, short duration impact, conditions such as are found in a percussive drill with a slight misalignment of the piston. Such deformation characteristics are not found in metallic materials usually used for prior art distributors. I have found that a distributor provided from a plastic material such as an acetal resin will work. I prefer the distributor to be made from material sold by E. I. DuPont DeNeMours Company under the trademark DELRIN 100.

It would also work to provide the distributor from a flexible nonmetallic material, as specified herein, without the rubber seals and grooves in the land portions, if the land portions were flexibly deformable themselves. Such flexibility could be provided by a land portions, being formed in an upwardly extending contact surface that extends upwardly toward the surrounding housing to contact the housing at a sealing area. This sealing area would, itself, be elastically deformable similar to the seals 80 and 94.

Having described the invention, what is claimed is:

1. A fluid distributor for flexible mounting in a pheumatic drill housing comprising;

(a) a body portion forming a central first passageway having a longitudinal axis therethrough;

(b) a flanged top end and a flanged bottom end on said body;

(c) second passageway means through said distributor for transmitting fluid flow during a stroke cycle of said drill, said second passageway means including at least one opening in said top end, said second passageway means extending lengthwise within said body portion, said second passageway means extending into said central passageway adjacent said bottom end;

(d) a plurality of raised land surfaces extending around a perimeter of said body encircling said longitudinal axis; and (e) a groove for retaining a flexible seal member in each land surface, said groove encircling said longitudinal axis.

2. The distributor of claim 1 wherein said body portion is flexible under high load, short duration impact conditions.

3. The distributor of claim 2 wherein said distributor is an acetal resin.

4. A fluid distributor for flexible mounting in a pneumatic drill housing comprising;

(a) a flexible body portion forming a central first passageway having a longitudinal axis therethrough;

(b) a flanged top end and a flanged bottom end on said body;

(c) second passageway means through said distributor for transmitting fluid flow during a stroke cycle of said drill, said second passageway means including at least one opening in said top end, said second passageway means extending lengthwise within said body portion and extending into said central passageway adjacent said bottom end and (d) a plurality of raised land surfaces extending around a perimeter of said body encircling said longitudinal axis, said land surfaces flexibly and sealingly in contact with said housing.

* * * * *